United States Patent [19]

Choushi et al.

[11] Patent Number: 4,643,137

[45] Date of Patent: Feb. 17, 1987

[54] ENGINE CONSTRUCTION

[75] Inventors: Masahiro Choushi; Shin Hiraoka, both of Hiroshima, Japan

[73] Assignee: Mazda Motor Corporation, Hiroshima, Japan

[21] Appl. No.: 733,747

[22] Filed: May 14, 1985

[30] Foreign Application Priority Data

May 14, 1984 [JP] Japan ..... 59-70710[U]

[51] Int. Cl.[4] ..... F02B 75/22

[52] U.S. Cl. ..... 123/52 MV; 123/52 M

[58] Field of Search ..... 123/52 M, 52 MV, 52 MB

[56] References Cited

U.S. PATENT DOCUMENTS

| | | | |
|---|---|---|---|
| 2,759,463 | 8/1956 | Platner | 123/52 MV |
| 4,267,812 | 5/1981 | Aula et al. | 123/52 MV |
| 4,425,881 | 1/1984 | Lyndhurst | 123/52 MV |

FOREIGN PATENT DOCUMENTS

| | | | |
|---|---|---|---|
| 586514 | 11/1958 | Italy | 123/52 MV |

*Primary Examiner*—Craig R. Feinberg

*Attorney, Agent, or Firm*—Burns, Doane, Swecker & Mathis

[57] ABSTRACT

A V-type engine construction which comprises an engine block having a pair of upwardly diverging cylinder banks with a generally V-shaped space defined therebetween and also having a plurality of engine cylinders defined in each of the cylinder banks, generally rectangular cylinder heads of identical shape adapted to be mounted on the respective cylinder banks, each of which cylinder heads has intake ports communicateable with the respective engine cylinders in the associated cylinder bank and defined therein so as to open generally towards the V-shaped space and also has two spaced coolant outflow ports which are in located adjacent front and rear ends of the respective cylinder head with respect to the direction of arrangement of the engine cylinders in the associated bank and are defined therein so as to open generally towards the V-shaped space, and an intake manifold integrally formed with lids one for each cylinder head, each of which lids is adapted to close one of the outflow ports in the associated cylinder head when the intake manifold is mounted on the cylinder heads.

15 Claims, 3 Drawing Figures

ENGINE CONSTRUCTION

BACKGROUND OF THE INVENTION

The present invention relates to a V-type automobile engine having a cylinder block with oppositely inclined banks and a cylinder head for each bank, in combination with an intake manifold.

In most automobiles now in use, a radiator is positioned either frontwardly or rearwardly of the internal combustion engine and is used to cool the coolant water which had been cooled by and pumped from the radiator and which, after having been passed through a continuous water jacket in the cylinder block and also through a continuous water jacket in the cylinder head, has been circulated back to the radiator for re-cooling. Because of this particular coolant flow path, an outflow port in the cylinder head for the discharge of the coolant water from the water jacket in the cylinder head is required to be formed at the front or rear end of the cylinder head, such as disclosed in, for example, the Japanese Laid-open Utility Model Publication No. 58-35645, laid open to public inspection on Mar. 8, 1983.

This equally applies to the automobile engine of a type comprising an engine block having oppositely inclined banks arranged generally in a V-shaped configuration, and cylinder heads one for each of the banks, that is, a so-called V-type automobile engine. Even in this V-type engine, the prior art is such that the coolant outflow port is required to be formed at the front or rear end of each of the cylinder heads.

The position of the coolant outflow port in each of the cylinder heads used in the V-type engine has been found posing a problem. Specifically, while the cylinder heads for the left-hand and right-hand banks of the cylinder block are structured symmetrical with respect to the axis of rotation and can therefore be constructed in identical shape, the position of the coolant outflow port in each cylinder head does not allow the use of the identical cylinder heads for any one of the banks of the cylinder block. This means that for one V-type engine, two types of cylinder head are required to be manufactured, accompanied by the increase in manufacturing cost of the engine as a whole.

SUMMARY OF THE INVENTION

Accordingly, the present invention has been developed with a view to substantially eliminating the above described disadvantages and inconveniences inherent in the prior art V-type engine and has for its essential object to provide an improved engine construction comprising a cylinder block having the banks utilizing the cylinder heads of identical design and shape.

To this end, the present invention provides an improved V-type engine construction which comprises an engine block having a pair of upwardly diverging cylinder banks with a generally V-shaped space defined therebetween and also having a plurality of engine cylinders defined in each of the cylinder banks, and generally rectangular cylinder heads of identical shape one for each cylinder bank and mounted on the respective cylinder banks, each of said cylinder heads having intake ports adapted to be communicated with the respective engine cylinders in the associated cylinder bank and defined therein so as to open generally towards the V-shaped space between the cylinder banks. Each of the cylinder heads also has two spaced coolant outflow ports located adjacent front and rear ends of the respective cylinder head with respect to the direction of arrangement of the engine cylinders in the associated bank and defined therein so as to open generally towards the V-shaped space in the vicinity of the respective openings of the intake ports adjacent the front and rear ends of such respective cylinder head. The engine construction also comprises an intake manifold integrally formed with lids one for each cylinder head, each of said lids being used to close one of the coolant outflow ports in the associated cylinder head when the intake manifold is mounted on the cylinder heads.

In the above described construction, one of the coolant outflow ports which is located adjacent the front end of one of the cylinder heads and one of the coolant outflow ports which is located adjacent the rear end of the other of the cylinder heads are rendered to be symmetrical with each other relative to the axis of rotation while the other of the coolant outflow ports located adjacent the rear end of such one of the cylinder heads and the other of the coolant outflow ports located adjacent the front end of such other of the cylinder heads are rendered to be symmetrical with each other relative to the axis of rotation. By so doing, one of the cylinder heads for one of the cylinder banks can be constructed identical in shape with the other of the cylinder heads for the other of the cylinder banks.

Moreover, since the coolant outflow ports, four in total number, are formed in the vicinity of the openings of the respective instake ports, two of the coolant outflow ports at the front or rear end of the engine, which are not required to be connected with external coolant passages, can be closed by the respective lids integral with the intake manifold.

Where the openings of the coolant outflow ports in each of the cylinder heads are rendered to lay in the same plane as the openings of the intake ports in such cylinder head, the structure of the respective lid integral with the intake manifold can be simplified and, in addition, a unitary gasket can be utilized to facilitate the fitting thereof.

BRIEF DESCRIPTION OF THE EMBODIMENT

This and other objects and features of the present invention will be readily understood from the following detailed description taken in conjunction with a preferred embodiment thereof with reference to the accompanying drawings, in which.

DETAILED DESCRIPTION OF THE EMBODIMENT

Figure 1:
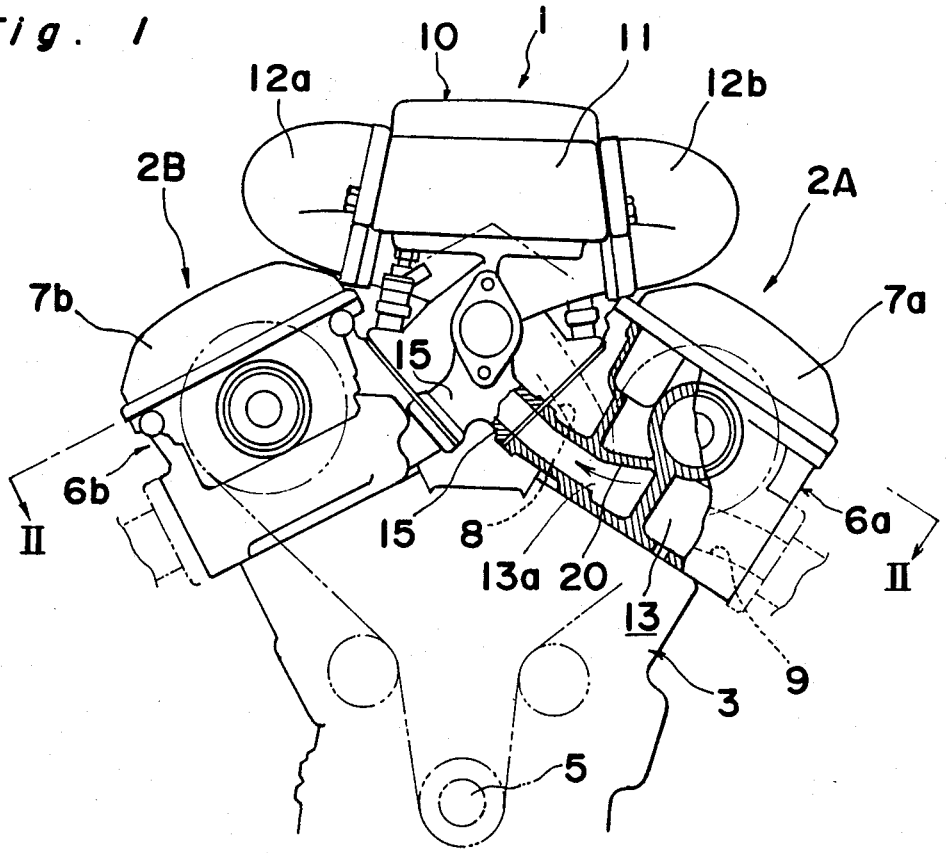
FIG. 1 is a transverse sectional view, with a portion cut away, of a V-type six-cylinder automobile engine embodying the present invention.

Before the description of the present invention proceeds, it is to be noted that like parts are designated by like reference numerals throughout the accompanying drawings.

Referring to the accompanying drawings, there is shown a V-6, OHC automobile engine 1 which includes a cylinder block 3 provided with first and second oppositely inclined, and upwardly diverging cylinder banks 2A and 2B arranged in a generally V-shaped configuration, each bank 2A or 2B having defined therein three engine cylinders **4*b*, 4*d* and 4*f*, or 4*a*, 4*c* and 4*e*, in which respective pistons (not shown) are reciprocably mounted. This cylinder block 4 has a generally rectangular bottom opening defined at its lower marginal edge to which an oil pan is fluid-tightly secured so as to define a crankcase. Within this crankcase, there is disposed a crankshaft 5 rotatably journalled in the cylinder block 4** at front and rear end walls and drivingly connected with all of the pistons by means of respective connecting rods as is well known to those skilled in the art.

Figure 2:
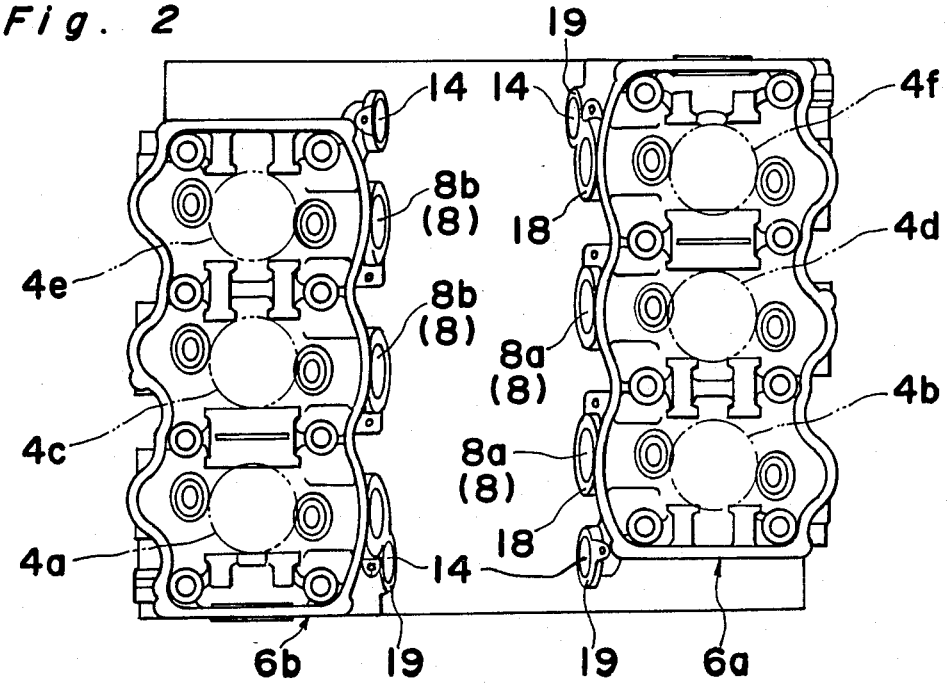
FIG. 2 is a schematic cross-sectional view taken along the line II—II in FIG. 2.
Figure 3:
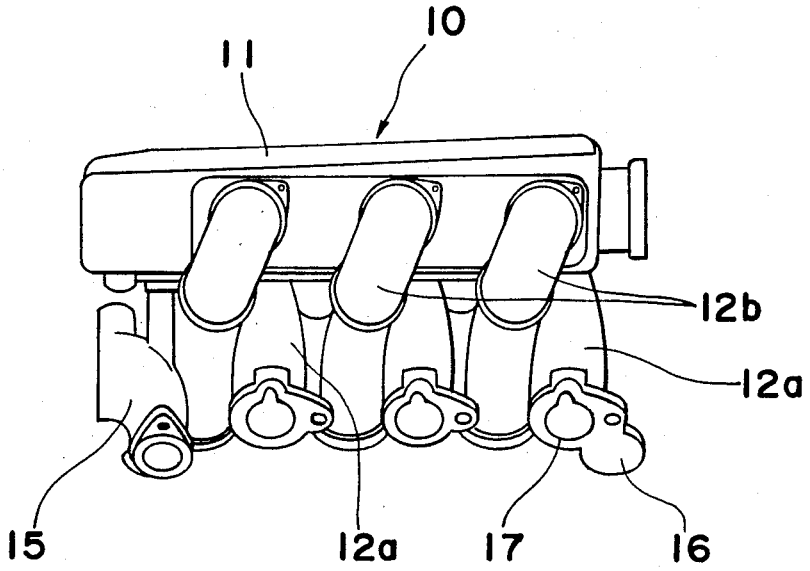
FIG. 3 is a side view of an intake manifold.

It is to be noted that, as can readily be understood from FIG. 2, the first or left-hand bank 2A and the second or right-hand bank 2B are displaced in position in a direction axially of the crankshaft 5, the first bank 2A being set back relative to the second bank 2B, and that, while the engine cylinders 4*b*, 4*d* and 4*f* in the first bank 2A and the engine cylinders 4*a*, 4*c* and 4*e* in the second bank 2B are even-numbered and odd-numbered, respectively, all of the engine cylinders 4*a* to 4*f* are, when viewed from top as shown in FIG. 2, staggered in a direction longitudinally of the engine 1, i.e., axially of the crankshaft 5.

The engine 1 also includes generally rectangular cylinder heads 6*a* and 6*b* each mounted fluid-tightly on top of the respective bank 2A or 2B through a gasket and having intake and exhaust ports generally identified by 8 and 9, respectively. The intake ports 8 defined in the first bank 2A in communication with the respective engine cylinders 4*b*, 4*d* and 4*f* and the intake ports 8 defined in the second bank 2B in communication with the respective engine cylinders 4*a*, 4*c* and 4*e* confront the generally V-shaped space delimited by the first and second banks 2A and 2B while the exhaust ports 9 defined in the first bank 2A in communication with the respective engine cylinders 4*b*, 4*d* and 4*f* and the exhaust ports 9 defined in the second bank 2B in communication with the respective engine cylinders 4*a*, 4*c* and 4*e* confront in respective directions opposite to each other, i.e., laterally outwardly of the engine 1. As is well known to those skilled in the art, all of the intake ports 8 are provided with respective intake valves for controlling the flow of air-fuel mixture into the associated engine cylinder whereas all of the exhaust ports 9 are provided with respective exhaust valves for controlling the discharge of exhaust gases from the associated engine cylinder.

These intake and exhaust valves are drivingly coupled with the connecting rods by way of cam mechanisms as is well known to those skilled in the art, which cam mechanisms are protected and covered by cylinder head coverings 7*a* and 7*b* each mounted on top of the respective cylinder head 6*a* or 6*b*.

An intake manifold 10 having a surge tank 11 and two groups of three intake pipings 12*a* and 12*b* is positioned in part within the V-shaped space between the first and second banks 2A and 2B and in part above the V-shaped space. The three intake pipings 12*a* in one of the groups extend laterally outwardly from a left-hand portion of the surge tank 11, are then bent downwardly so as to acutely extend diagonally downwards below the surge tank 11 and are finally fluid-connected through a gasket or separate gaskets with intake openings 8*a* leading to the respective intake ports 8 in the cylinder head 6*a* on the first bank 2A. Similarly, the three intake pipings 12*b* in the other of the groups extend laterally outwardly from a right-hand portion of the surge tank 11, are then bent downwardly so as to acutely extend diagonally downwards below the surge tank 11 and are fluid-connected through a gasket or separate gaskets with intake openings 8*b* leading to the respective intake ports 8 in the cylinder head 6*b* on the second bank 2B. It is to be noted that the intake manifold 10 including the surge tank 11 and the groups of the intake pipings 12*a* and 12*b* may be of one-piece construction.

In accordance with the present invention, the cylinder heads 6*a* and 6*b* which have been shown and described as mounted on the first and second banks 2A and 2B are identical in both construction and shape so that any one of the cylinder heads 6a and 6b can be suited to the mounting on any one of the banks 2A and 2B with no need to manufacture of two types of cylinder head for the mounting on the respective banks. For this purpose, since the second, fourth and sixth engine cylinders 4*b*, 4*d* and 4*f* in the first bank 2A are in symmetrical relationship with the fifth, third and first engine cylinders 4*e*, 4*c* and 4*a* in the second bank 2B, respectively, relative to a point lying on the imaginary line generally perpendicular to the longitudinal sense of the engine 1, the intake and exhaust ports 8 and 9 in the cylinder head 6*a* are also in symmetrical relationship with the intake and exhaust ports 8 and 9 in the cylinder head 6*b*, respectively. The cam mechanisms incorporated in the cylinder head 6*a* and those incorporated in the cylinder head 6*b* are so structured as to assume a symmetrical relationship with each other.

Each of the cylinder heads 6*a* and 6*b* has two coolant outflow ports 14 communicated with a water jacket 13, defined in the respective cylinder head 6*a* or 6*b*, and defined therein so as to confront the V-shaped space between the banks 2A and 2B, one of the outflow ports 14 being located adjacent a front end of the respective cylinder head 6*a* or 6*b* while the other of the outflow ports 14 is located adjacent a rear end of such respective cylinder head 6*a* or 6*b*. The outflow ports 14 in both of the cylinder heads 6*a* and 6*b* are so positioned and so shaped that the outflow port 14 adjacent the front end of the cylinder head 6*a* and the outflow port 14 adjacent the rear end of the cylinder head 6*b* are symmetrical in position with each other while the outflow port 14 adjacent the rear end of the cylinder head 6*a* and the outflow port 14 adjacent the front end of the cylinder head 6*b* are symmetrical in position with each other.

For communicating the water jackets 13 in the cylinder heads 6*a* and 6*b* with respective coolant conduits 15 leading to a radiator (not shown) and joined together at an upstream region with respect to the direction of flow of the coolant towards the radiator, only the outflow ports 14 adjacent the front or rear ends of the respective cylinder heads 6*a* and 6*b* are utilized. In the illustrated embodiment, the outflow ports 14 each adjacent the front end of the respective cylinder head 6*a* and 6*b* is communicated with the associated coolant conduit 15 while the outflow ports 14 adjacent the rear ends of the rear ends of the respective cylinder heads 6*a* and 6*b*, which are no longer communicated with any coolant conduits, are fluid-tightly closed by respective lids 16, each of said lids 16 being integrally formed with a respective annular flange 17 of the associated intake piping 12*a* or 12*b* of the intake manifold 10.

More specifically, annular end faces 18 of the intake ports 8 around the intake openings 8*a* or 8*b* in each of the cylinder heads 6*a* and 6*b* are so formed as to lie in the same plane for the purpose of facilitating the connection with the intake manifold 10, whereas the outflow ports 14 adjacent the front and rear ends of each of the cylinder heads 6*a* and 6*b* are so formed as to occupy respective positions as close as possible to the neighboring intake openings 8*a* or 8*b* and as to have respective annular end faces 19 lying in the same plane as any one of the annular end faces 18 around the intake openings 8*a* or 8*b* in the respective cylinder head 6*a* and 6*b*.

The lid 16 for fluid-tightly closing the outflow port 14 adjacent the rear end of the cylinder head 6*a* on the first bank 2A is integrally formed with the annular flange 17 of one of the intake pipings 12*a*, which is to be fluid-connected with one of the intake ports 8 which is in communication with the sixth engine cylinder 4*f*, so as to lay in the same plane as such annular flange 17. Similarly, the lid 16 for fluid-tightly closing the outflow port 14 adjacent the rear end of the cylinder head 6*b* on the second bank 2B is integrally formed with the annular flange 17 of one of the intake pipings 12*b*, which is to be fluid-connected with one of the intake ports 8 which is in communication with the fifth engine cylinder 4*e*, so as to lay in the same plane as such annular flange 17.

It is to be noted that, in the illustrated embodiment, the coolant conduits 15 are carried by the intake manifold 10 with their common upstream region rigidly secured to, or otherwise integrally formed with, a front lower region of the surge tank 11 and located within the V-shaped space between the first and second banks 2A and 2B.

For avoiding an undesirable reduction in cooling performance which would result in as a result of the accumulation of bubbles within one or both of the water jackets 13 in the respective cylinder heads 6*a* and 6*b*, an upper wall 20 of the water jacket 13 at a portion thereof adjacent the outflow port 14 in each of the cylinder heads 6*a* and 6*b* is so formed as to incline at an angle of 2 to 4 degrees relative to the horizontal datum with its downstream side raised, while the associated outflow port 14 is so formed as to extend upwards from an exit region 13*a*.

From the foregoing description, it has now become clear that the formation of the outflow ports 14 adjacent the front and rear ends of each of the cylinder heads for the first and second banks in identical structure and shape, resulting in the reduced cost of manufacture of the engine as a whole. Moreover, the provision of the lids 16 integral with the annular flanges 17 of the intake pipings 12*a* and 12*b* of the intake manifold 10 is advantageous in that, when the intake manifold 10 is mounted on the engine 1 with the intake pipings 12*a* and 12*b* fluid-connected with the intake ports 8*a* and 8*b* in the cylinder heads 6*a* and 6*b*, some of the outflow ports 14 in the cylinder heads which are not utilized for the flow of the coolant water can be readily closed fluid-tightly, in so far as the annular end faces 19 of the outflow ports 14 in each cylinder head are so arranged as to lay in the same plane as the annular end faces of the intake ports 8 around the respective intake openings 8*a* or 8*b* in such cylinder head while such outflow ports are located adjacent the intake ports 8 adjacent the front and rear ends of such cylinder head.

However, it is not always essential in the practice of the present invention to provide the annular end faces 19 of the outflow ports 14 in each cylinder head to lay in the same plane as the annular end faces 18 of the intake ports 8 around the intake openings 8*a* or 8*b* in such cylinder head, although this design feature is advantgeous in that a single gasket can be used between the annular end faces of both of the outflow ports and the intake ports in each of the cylinder heads and both of the lid and the annular end faces of the intake pipings in each group of the intake manifold.

Although the present invention has fully been described in connection with the preferred embodiment thereof with reference to the accompanying drawings, it is to be noted that various changes and modifications are apparent to those skilled in the art. By way of example, although reference has been made to the V-type automobile engine having the six engine cylinders, the number of the engine cylinders may not be always limited to six.

Accordingly, such changes and modifications are to be understood as included within the scope of the present invention as defined by the appended claims unless they depart therefrom.

We claim:

1. A V-type engine construction which comprises, in combination:

an engine block having a pair of upwardly diverging cylinder banks and also having a plurality of engine cylinders defined in each of the cylinder banks, said cylinder banks being displaced a certain distance from each other in a direction parallel to an engine output shaft;

cylinder heads of identical shape having respective coolant water jackets defined therein and adapted to be mounted on the respective cylinder banks, each of said cylinder heads having intake ports communicateable with the respective engine cylinders in the associated cylinder banks and defined therein so as to open generally towards a space between the cylinder heads and also having two spaced coolant outflow ports, said outflow ports in each of the cylinder heads being located adjacent to and inwardly of the two intake ports, which are respectively closest to front and rear ends of the respective cylinder head with respect to the direction of arrangement of the engine cylinders in the associated bank, and defined therein so as to open generally towards the space between the cylinder heads;

an intake manifold adapted to be mounted on the cylinder heads with a downstream end thereof communicated with the intake ports in each said cylinder head, said intake manifold comprising a surge tank positioned within the space between the cylinder heads, an intersecting area where a first suction manifold communicated with the surge tank and with the intake ports in one of the cylinder heads at a location beneath the surge tank and a second suction manifold communicated with the surge tank and with the intake ports in the other of the cylinder heads at a location beneath the surge tank, an intersecting area intersect with each other, and a generally U-shaped area curved so as to represent the shape of a figure "U" for communicating the intersecting area and the surge tank together;

lids formed integrally with the intersecting area of the intake manifold for closing off flow through respective ones of the outflow ports in the associated cylinder heads when the intake manifold is mounted on the cylinder heads;

a coolant conduit means formed integrally with the intersecting area of the intake manifold and adapted to be communicated with the other of the outflow ports in each said cylinder head;

each of the cylinder heads having a water jacket defined therein, the two coolant outflow ports in each of the cylinder heads in communication with the water jacket of the cylinder head;

the lids positioned so as to align with and close off flow through one of the outflow ports in one cylinder head and one of the outflow ports in the other cylinder head, the one outflow port in the other cylinder head being in a juxtaposed position with respect to said one of the outflow ports in said one cylinder head when the manifold is mounted on the cylinder heads.

2. A V-type engine construction which comprises, in combination:

an engine block having a pair of upwardly diverging cylinder banks and also having a plurality of engine cylinders defined in each of the cylinder banks;

cylinder heads having respective coolant water jackets defined therein and adapted to be mounted on the respective cylinder banks, each of said cylinder heads having intake ports communicateable with the respective engine cylinders in the associated cylinder bank and defined therein so as to open generally towards a space between the cylinder heads and also having at least two spaced coolant outflow ports, said outflow ports in each of the cylinder heads being located adjacent the intake ports in each said cylinder head and defined therein so as to open generally towards the space between the cylinder heads; and an intake manifold adapted to be mounted on the cylinder heads so as to be communicated with the intake ports and formed with a unitary lid, said unitary lid, when the intake manifold is mounted on the cylinder heads, closing off flow through at least one of the outflow ports, said unitary lid forming a part of that mounting flange of the intake manifold through which the intake manifold is mounted on the cylinder heads;

each of the cylinder heads having a water jacket defined therein, the two coolant outflow ports in each of the cylinder heads in communication with the water jacket of the cylinder head;

the lid positioned so as to align with and close off flow through one of the outflow ports in one cylinder head and one of the outflow ports in the other cylinder head, the one outflow port in the other cylinder head being in a juxtaposed position with respect to said one of the outflow ports in said one cylinder head when the manifold is mounted on the cylinder heads; and, a coolant conduit means for communicating with outflow ports of the respective cylinder heads not closed off by the lids.

3. A construction as claimed in claim 2, further comprising a conduit for each cylinder head integrally formed with the intake manifold, said conduit being communicateable with at least one of the remaining outflow ports.

4. A construction as claimed in claim 3, wherein the outflow ports in each said cylinder head have respective annular end faces adapted to be held in abutment with the intake manifold and the intake ports in each said cylinder head have respective annular end faces adapted to be held in abutment with the intake manifold, said annular end faces of the outflow ports laying in the same plane as said annular end faces of the intake ports.

5. A V-type engine construction which comprises, in combination:

an engine block having a pair of upwardly diverging cylinder banks and also having a plurality of engine cylinders defined in each of the cylinder banks;

cylinder heads of identical shape adapted to be mounted on the respective cylinder banks, each of said cylinder heads having intake ports communicateable with the respective engine cylinders in the associated cylinder banks and defined therein so as to open generally towards a space between said cylinder heads and also having two spaced coolant outflow ports, said outflow ports in each of the cylinder heads being located adjacent front and rear ends of the respective cylinder head with respect to the direction of arrangement of the engine cylinders in the associated bank and defined therein so as to open generally towards the space between the cylinder heads;

an intake manifold integrally formed with lids one for each cylinder head, said lids, when the intake manifold is mounted on the cylinder heads, closing off flow through respective ones of the outflow ports in the associated cylinder heads which are located in one of frontwardly and rearwardly with respect to a direction parallel to an engine output shaft;

each of the cylinder heads having a water jacket defined therein, the two coolant outflow ports in each of the cylinder heads in communication with the water jacket of the cylinder head;

the lids positioned so as to align with and close off flow through one of the outflow ports in one cylinder head and one of the outflow ports in the other cylinder head, the one outflow port in the other cylinder head being in a juxtaposed position with respect to said one of the outflow ports in said one cylinder head when the manifold is mounted on the cylinder heads; and, a coolant conduit means for communicating with outflow ports of the respective cylinder heads not closed off by the lids.

6. A construction as claimed in claim 5, wherei the outflow ports in each said cylinder head being located adjacent to and inwardly of the two intake ports, which are respectively closest to front and rear ends of the respective cylinder head with respect to the direction of arrangement of the engine cylinders in the associated bank.

7. A construction as claimed in claim 5, wherein the outflow ports in each said cylinder head are formed in the vicinity of the intake ports in each said cylinder head, respectively.

8. A construction as claimed in claim 7, wherein the intake ports, in the vicinity of which the outflow ports are located, respectively, are located closest to, but inwardly of the front and rear ends of each said cylinder head, respectively.

9. A construction as claimed in claim 5, wherein the manifold is also integrally formed with a coolant conduit means adapted to be communicated with the other of the outflow ports in each said cylinder head.

10. A construction as claimed in claim 9, wherein the outflow ports in each said cylinder head have respective annular end faces adapted to be held in abutment with the intake manifold and the intake ports in each said cylinder head have respective annular end faces adapted to be held in abutment with the intake manifold, said annular end faces of the outflow ports laying in the same plane as said annular end faces of the intake ports.

11. A construction as claimed in claim 10, further comprising a unitary gasket interposed between the annular end faces of both of the outflow ports and the intake ports and the intake manifold.

12. A construction as claimed in claim 9, wherein the coolant conduit means comprises a pair of diverging conduits adapted to be communicated at one end with the other of the outflow ports in one of the cylinder heads and that in the other of the cylinder heads, respectively, the other ends of the respective conduits being joined together to provide a joint area, said intake manifold being supported with the joint area positioned in the space between the cylinder banks.

13. A construction as claimed in claim 12, wherein the intake manifold is of one-piece construction together with the joint area of the coolant conduit means.

14. A construction as claimed in claim 12, wherein the intake manifold extends diagonally upwardly in an upstream direction at a portion adjacent each of the cylinder heads and wherein each of the conduits extends diagonally upwardly in a downstream direction therealong, said joint region extending in a direction conforming to the direction of arrangement of the engine cylinders.

15. A construction as claimed in claim 14, wherein an upper wall of each of the outflow ports of a water jacket in each of the cylinder heads, which wall is located adjacent the opening of the respective outflow port, is diagonally upwardly inclined towards such opening of such outflow port.

* * * * *